United States Patent [19]

Mancini et al.

[11] 4,375,259

[45] Mar. 1, 1983

[54] TOOL KIT FOR WATCH STRAP REPLACEMENT

[75] Inventors: William Mancini, Prospect; Carl Weiss, Oakville; Theodore Grohoski, Woodbury, all of Conn.

[73] Assignee: Timex Corporation, Waterbury, Conn.

[21] Appl. No.: 290,769

[22] Filed: Aug. 7, 1981

[51] Int. Cl.[3] ..... B25B 11/00; B25B 31/00; B65D 69/00

[52] U.S. Cl. ..... 206/223; 81/3 R; 206/349; 206/372; 206/374; 211/60 T; 29/225; 269/16

[58] Field of Search ..... 206/229, 230, 223, 373, 206/379, 349; 81/3.46 R, 3.46 A, 3.47, 3.48, 3.49, 5.1, 6, 3 R, 7; 269/5, 16, 287, 288, 308, 293; D3/30; D10/128; D8/71, 72, 88, 89; 29/225, 227, 270, 232, 231, 453, 177; 63/21; 211/60 T

[56] References Cited

U.S. PATENT DOCUMENTS

| | | | |
|---|---|---|---|
| D. 247,215 | 2/1978 | Nassau | D8/88 |
| D. 264,044 | 4/1982 | Lazazzera | D8/88 |
| 516,119 | 3/1894 | Rudolph | 269/286 |
| 996,968 | 7/1911 | Broussaud | 281/19 R |
| 1,024,388 | 4/1912 | Bartlett | 206/379 |
| 3,650,392 | 3/1972 | Haagedoorn | 206/369 |

*Primary Examiner*—Allan N. Shoap
*Assistant Examiner*—Jimmy G. Foster
*Attorney, Agent, or Firm*—William C. Crutcher; Joseph A. Biela

[57] ABSTRACT

A tool kit is provided for enabling easy removal and attachment of a watch strap or band to a watch using spring bar type connectors. The tool kit comprises a work table and one or more tools which are stored in compartments in the work table and held releasably therein by detent means. The work table includes a watch support pad on which the watch is positioned for removal and attachment of the strap or band with one of the tools, the pad being made of rubber or other suitable material so as not to harm the watch finish. The work table also includes a pintle-compressing member in the form of a generally upright plate-like member having a first side wall and a recessed second side wall connected together at one end by a narrow end wall whose thickness is selected to compress a pintle of the spring bar connector when the plate-like member is positioned between a free watch case lug and a free end of the connector with the other end of the connector being engaged against the other watch case lug. The recess in the second side wall extends toward and terminates at the end wall and is designed to receive the free pintle of the spring bar connector and guide it into engagement with the free watch case lug to complete attachment of the watch strap and connector to the lugs. The tools stored in the work table may be used to both remove and attach a watch strap or band to a watch. A cover member fits over the work table and is configured to capture the tools when stored in the storage compartments to prevent tool loss.

8 Claims, 20 Drawing Figures

TOOL KIT FOR WATCH STRAP REPLACEMENT

FIELD OF THE INVENTION

The present invention relates to a work table and tool kit for removing and attaching a watch strap, band and the like to the lugs of a watch case.

BACKGROUND OF THE INVENTION

At the present time, wrist watch straps, bands and bracelets are secured to the spaced projecting lugs on a wrist watch case by means of a spring bar connector. The spring bar connector customarily employed comprises a tubular housing within which is mounted a pair of pintles that are spring urged outwardly. This type of connector has found almost universal acceptance in the field. Typically, the connector is inserted in a loop or other passage at each end of the watch strap. To attach the strap to the watch lugs, one projecting pintle of the connector is inserted in a hole provided in each lug and then the other pintle is first retracted into the tubular housing, aligned with the hole in the other lug and released so that the pintle is urged into the hole by spring action. Retraction of the projecting pintle is usually accomplished by pushing the end of the pintle inwardly until it is retracted sufficiently to align the spring bar in proper position relative to the lug holes. The overall operation of inserting the spring bar connector in position between the lugs of the watch case is a tedious one and is often quite difficult because of the shape and contour of the watch and the limited space available. The projecting pintles of the connector are also quite small and difficult to retract without some type of tool. Of course, removal of the end attachment is likewise fraught with difficulties.

In the past, tools of various types have been used in attempts to facilitate removal or attachment of the watch strap having spring bar type connectors. For example, the consumer who purchases a replacement watch strap has frequently used the blade of a penknife to effect removal of the old watch strap and attachment of the new strap. This technique, of course, presents certain safety hazards and is not entirely satisfactory. Jewelers on the other hand, have employed a special tool for this purpose. The tool typically has a pin on one end for watch lugs having through-holes, i.e. extending completely through the lug, and a forked-portion on the other end for watch case lugs having holes extending only partially therethrough. Removal of the watch strap in the former instance is accomplished simply by inserting the pin of the tool into the through-hole of one lug and pushing the end of the spring bar connector to retract its spring-urged pintle sufficiently to release the connector from that lug. The connector and strap are then easily freed from the other lug. In the latter instance, the forked-portion of the tool is inserted between one of the watch case lugs and the pintle of the spring bar connector, straddling the spring bar connector. The forked end is tapered and portions thereof contact an annular shoulder typically formed on the retractable pintle of the connector. When the forked-end is pushed onto the connector, the tapered portion compresses the retractable pintle slightly to partially disengage it from the lug hole. The tool must then be twisted or pushed to free the connector and strap from that lug. The connector and strap are then easily freed from the other lug.

There is still recognized a need to provide a device or other tool with which the spring bar connector of a watch strap can be easily removed from and fastened to the spaced lugs of a watch case, especially by unskilled individuals.

The Linnbaum U.S. Pat. No. 246,522 issued Aug. 30, 1881 and the Flip U.S. Pat. No 2,679,776 issued June 1, 1954 disclose horological tools apparently intended for uses other than removing a spring bar connector from the watch case lugs. The Niel U.S. Pat. No. 2,700,910 issued Feb. 1, 1955 discloses a plier-like tool having a bifurcated lower jaw with tapered claws for effecting removal of a sheet metal spring nut from a stud without damaging either component.

SUMMARY OF THE INVENTION

It is an object of the present invention to provide a work table adapted for assisting in the removal and attachment of a watch strap connector of the spring bar type between the spaced inner lug surfaces of a watch case.

It is another object of the invention to provide a tool kit which can be used by unskilled retail clerks, consumers and others to easily remove and attach a watch strap or band with spring bar type connectors.

A typical work table of the invention includes a working surface, preferably horizontally oriented, carrying watch support pad means thereon. The watch support pad means is suitably sized to accommodate various sizes and shapes of watches and is made of a soft, nonabrasive material which will not harm the watch finish when the watch is placed on the pad means for strap or band removal as described hereinbelow. The work table also includes as an important feature a pintle-compressing member typically in the form of an upright plate-like member having a first side wall and a second side wall, preferably with an elongated recess therein, connected together at one end by a narrow end wall of selected thickness. The elongated recess provided in the second side wall extends toward and terminates at the end wall for purposes which will become evident. The thickness of the end wall of the plate-like member is selected to compress a pintle of the connector when the plate-like member is interposed between the facing inner lug surfaces with the first side wall immediately adjacent one inner lug surface in partial overlapping relation thereto such that a portion of the adjacent lug surface extends past the end wall and with the second side wall in spaced, facing relation to the other inner lug surface with the spring bar connector therebetween. In this arrangement, one (free) pintle of the connector is engaged in the recess in the second wall of the pintle-compressing member while the other pintle is engaged against the facing inner lug surface. Attachment of the free pintle of the watch strap connector to the free inner lug surface adjacent the first side wall is achieved simply by sliding the pintle along the elongated recess in the second side wall toward and past the end wall of the pintle-compressing member such that the pintle will expand and enter the mating lug hole located in the prealigned free inner lug surface when the end wall is passed. Attachment of the watch strap connector is thus completed since the other pintle has already been engaged with the mating lug hole located in the other inner lug surface.

The work table also preferably includes one or more storage compartments for storing one or more strap removal/attachment tools when not in use. Detent means associated with the work table extends into the storage compartments to releasably hold the tools therein.

The tool kit of the invention includes the work table described hereinabove and one or more removal/attachment tools housed in storage compartments of the work table. Each tool usually is in the form of a shaft having handle means at one end and a bifurcated, chisel-shaped blade at the other end. The blade may be straight or angled. Preferably, the handle means includes a first groove at the inner end adapted to engage the detent means extending into the storage compartment of the work table to releasably hold the tool in the compartment and a second groove at the outer, exposed end to facilitate manual removal of the tool from the storage compartment. The tools are useful in removing watch strap connectors in which the spring-urged pintles have an annular shoulder near their ends and the majority of spring bar type connectors used today have such pintles. Removal of a watch strap is accomplished by placing the watch on the work table with the watch crystal located on the watch support pad to expose the backside of the watch. While holding the watch on the pad, the dismantling tool is simply placed over the spring bar connector (straddling the connector) at one end thereof with the flat first surface of the tool blade adjacent the inner surface of one of the watch case lugs and the tapered second side adjacent the shoulder of the spring-urged pintle engaged to that lug. The dismantling tool is then simply pushed toward the watch support pad of the work table causing the tapered second surface of the tool blade to exert an axial camming action on the pintle shoulder away from the lug and causing sufficient retraction of the pintle from the lug to effect release. With one of the spring-urged pintles released, the other is easily freed to remove the watch strap from the watch case lugs.

The tools are also useful in attaching metal type bands or bracelets that may be difficult to assemble using the pintle-compressing member of the work table. Attachment of such bands or bracelets with the tools is generally the reverse procedure from removal.

A cover member is also preferably provided as part of the tool kit to engage over the work table to provide a neat, compact device. The cover member preferably is configured to capture the exposed handle means of the tools stored in the compartments of the work table to prevent accidental tool loss.

DESCRIPTION OF PREFERRED EMBODIMENTS

Figure 7A:
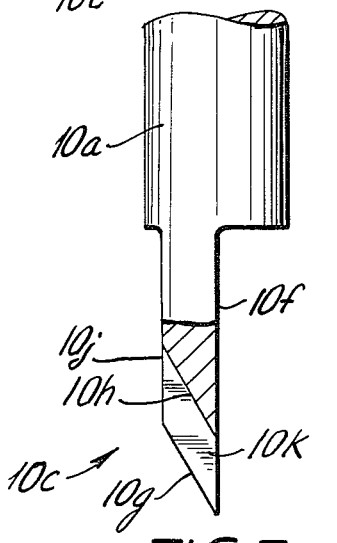
Figure 7B:
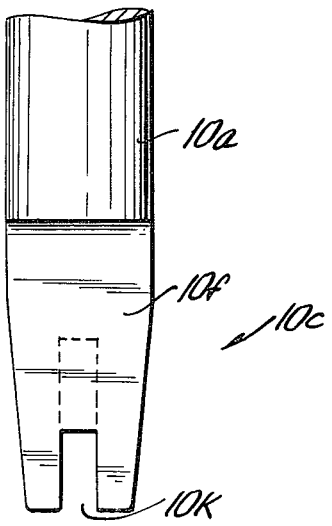
Figure 8A:
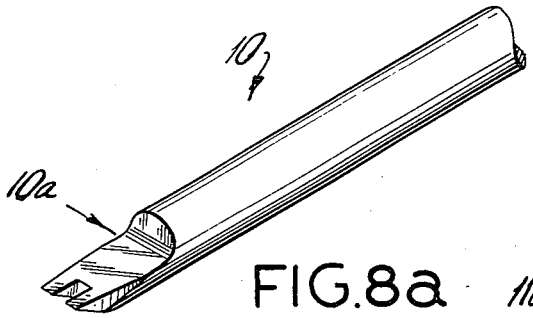
Figure 8B:
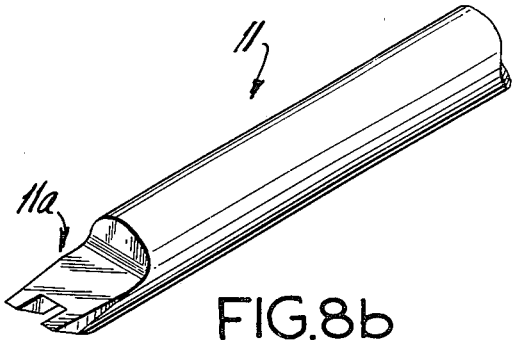
Figure 8C:
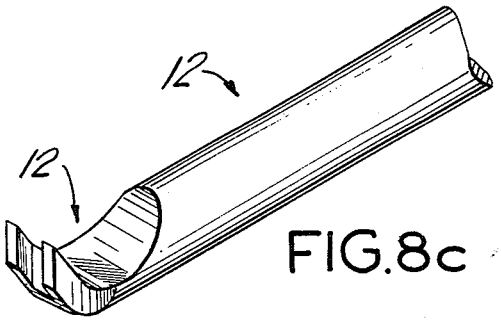
Figure 8D:
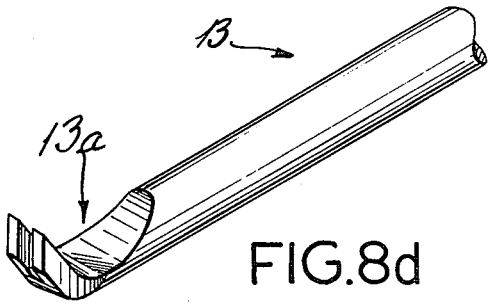

FIGS. 7*a* and 7*b* are enlarged elevational views of the straight chisel-shaped blade of the tool.

Figure 3:
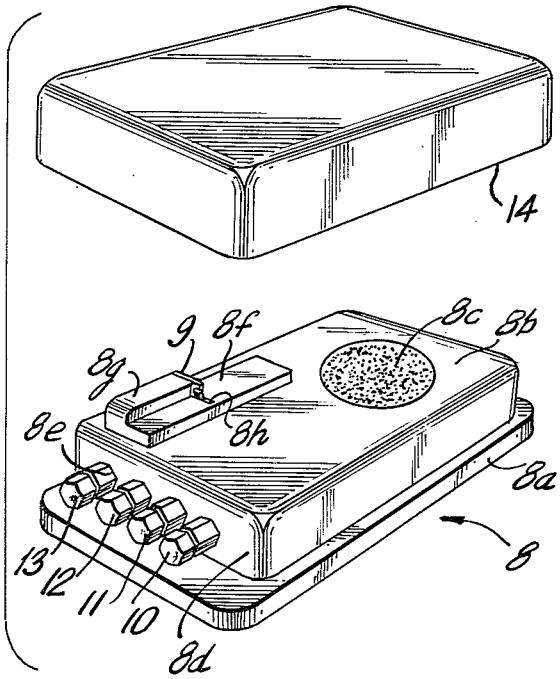
FIG. 3 is a perspective view of the tool kit.

FIGS. 8*a* through 8*d* are perspective views showing the chisel-shaped blades of the four tools of FIG. 3.

Figure 9A:
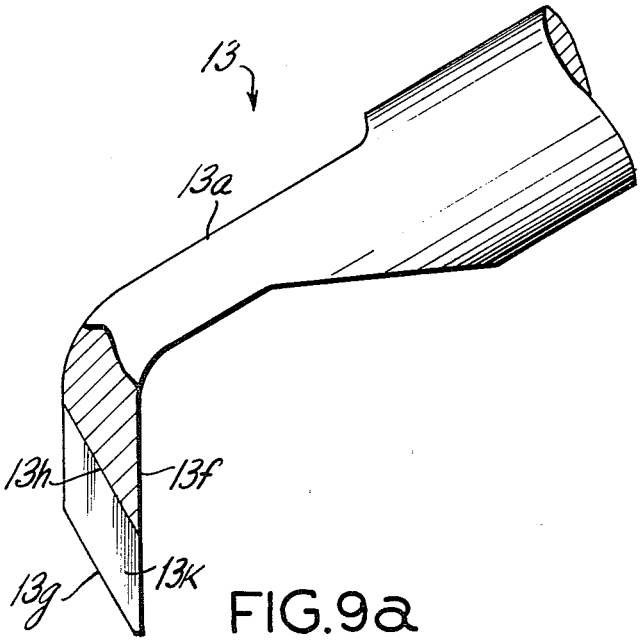
Figure 9B:
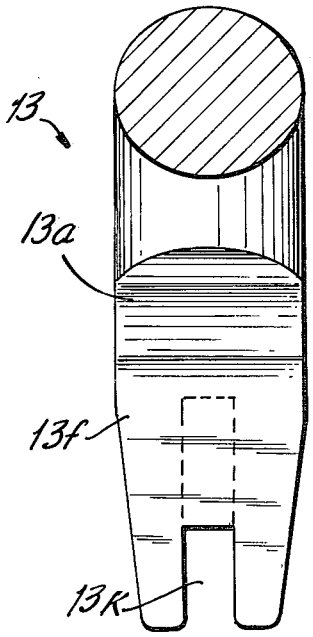

FIGS. 9*a* and 9*b* are enlarged elevational views of the curved chisel-shaped blade of another tool.

Figure 10A:
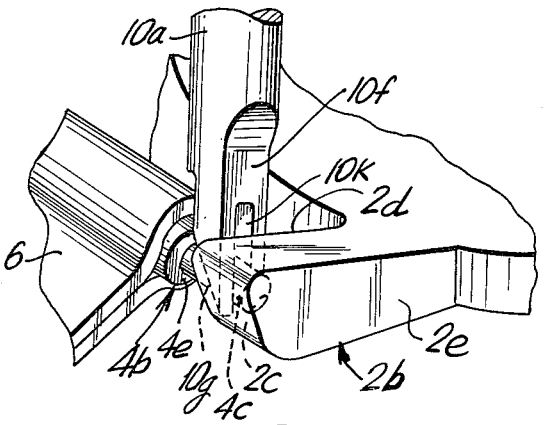
Figure 10B:
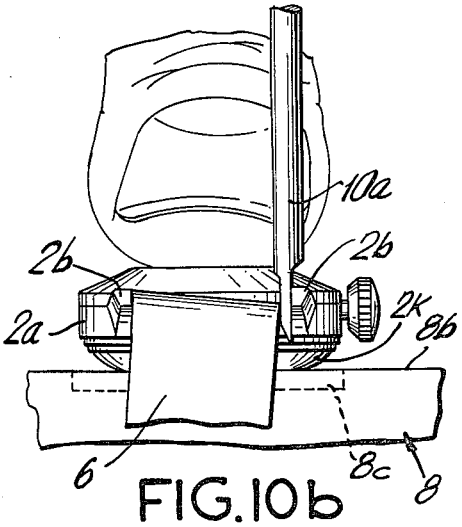

FIGS. 10*a* and 10*b* are perspective views showing steps in the removal of a watch strap with a tool.

Figure 11A:
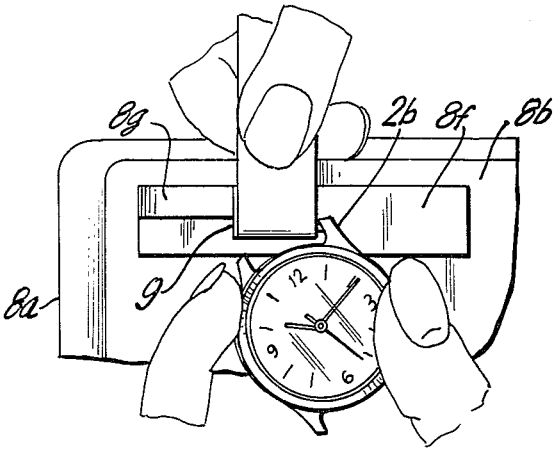
Figure 11B:
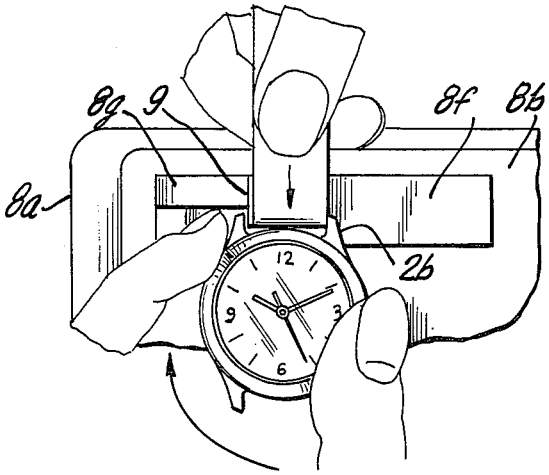

FIGS. 11*a* and 11*b* are perspective views showing steps in the attachment of a watch strap with the work table member.

Figure 12:
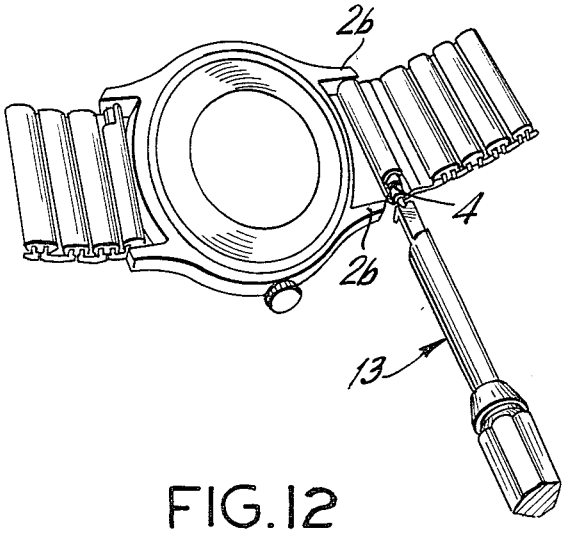

FIG. 12 is a perspective view showing attachment of a watch band with a tool having an angled chisel-shaped blade.

Figure 13:
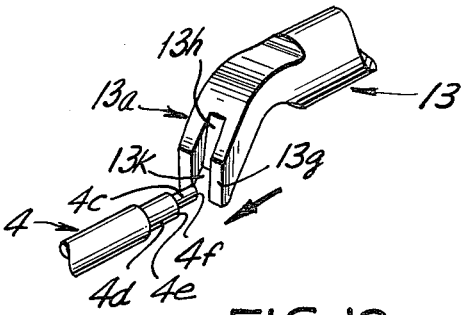

FIG. 13 is a partial perspective view showing how the curved blade of a tool is used to compress the end of the spring bar connector for strap attachment.

DESCRIPTION OF PREFERRED EMBODIMENTS

Figure 1:
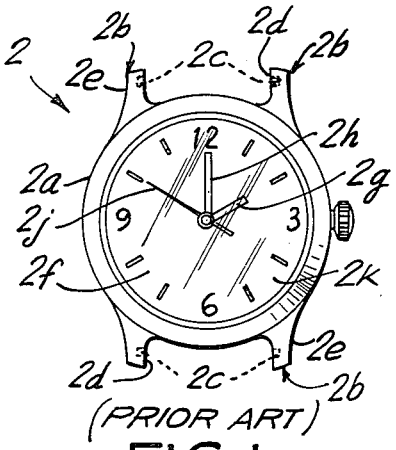
(PRIOR ART) FIG.1
FIG. 1 is a top elevational view of a typical prior art wristwatch.
Figure 2:
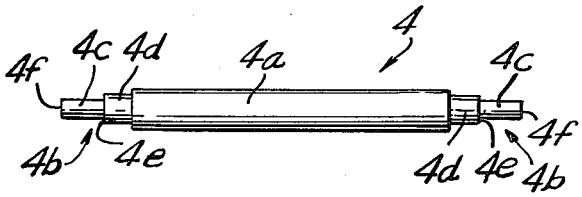
(PRIOR ART) FIG.2
FIG. 2 is a top elevational view of a typical prior art spring bar connector.

Referring to FIGS. 1 and 2, there are shown a conventional wristwatch 2 and spring bar connector 4, respectively. The wristwatch comprises a case or bezel 2*a* having spaced, facing lugs 2*b* between which the spring bar connector is inserted. Each lug includes a blind hole 2*c* extending from the inner lug surface 2*d* toward the outer lug surface 2*e* (see FIG. 10*a*). Of course, if desired, the holes may extend through each lug as is the case with some wristwatches. The wristwatch is illustrated as having a dial plate 2*f* which in combination with the rotating hands 2*g*, 2*h*, 2*j* provide time information. Of course, the other types of time display schemes may be employed; for example, time could be displayed in digital form using well known electrooptical displays such as liquid crystal displays or in hybrid digital-analog form using electro-optical displays alone or in conjunction with a dial plate and rotating hands.

The spring bar connector is shown as comprising a tubular housing 4*a* formed of bent sheet metal and spring-urged pintles 4*b* inserted into opposite ends of the housing. Each pintle typically includes an outer small-diameter pin 4*c* with ends 4*f* for engagement in the holes 2*c* of the watch case lugs and an inner, larger-diameter shaft 4*d* which slides within the tubular housing. An annular shoulder 4*e* is formed between the outer pin and inner shaft. Although not shown, a coil spring or other suitable spring means is placed in the tubular housing between the pintles 4*b* to urge them outwardly into engagement with the lug holes and at the same time allow them to be at least partially retracted into the tubular housing during strap removal or attachment. Of course, the spring bar connector 4 is usually received within a loop formed at the end of the watch strap, band or bracelet 6, for example, as shown in FIG. 10*a*. As used hereinafter, "strap" is intended to include straps, bands, bracelets and the like made of leather, plastic, metal and other materials.

Figure 5:
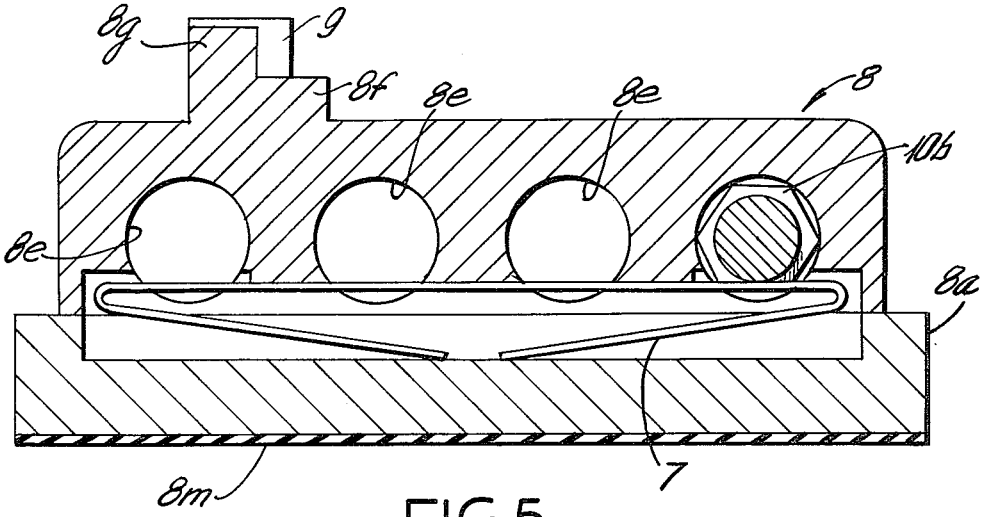
FIG. 5 is a cross-sectional view showing a detent spring extending into the storage compartments in the work table to engage the inner groove in the tool handle.

The tool kit of the invention includes the work table 8 and tools 10–13 shown in FIG. 3. The work table member comprises a rectangular base 8*a* of metal, plastic or other suitable material having a top working surface 8*b*. Disposed in a recess in the working surface is a watch support pad 8*c* on which the wristwatch is placed during strap removal or attachment as described herebelow. The watch support pad is made of soft nonabrasive material such as rubber, vinyl, felt and the like which will not mar or otherwise damage the finish of the watch when placed thereon as described below. Although the watch support pad 8*c* is shown as having a circular cross-section, it is apparent that other shapes and sizes may be employed as well to accommodate the range of watch sizes and shapes in use today. Machined, molded or otherwise formed in the work table preferably at one end 8*d* thereof are four or other suitable number of cylindrical storage compartments 8*e* adapted to receive the tools. The tools are held in position in the storage compartments by means of a spring detent 7 extending inside the compartments (FIG. 5) acting on an inner groove provided in the handle of each dismantling tool as described hereinafter. Of course, other types of spring detents can be employed.

Figure 4:
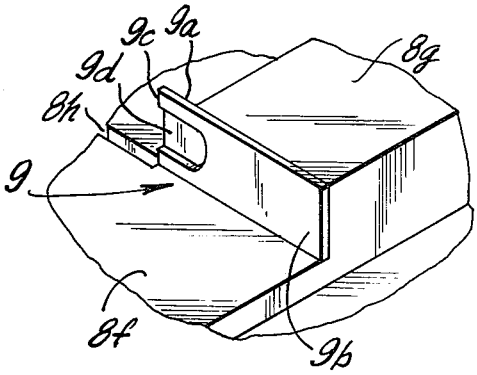
FIG. 4 is a close-up perspective view of the support wall of the work table.

Supported above the working surface 8*b* by support blocks 8*f* and 8*g* is pintle-compressing member 9 (FIG. 4) in the form of a small metal plate having a first side wall 9*a* and a second side wall 9*b* with a recess 9*d* held against the end of support block 8*g* for example by interference fit in slot 8*h* in support block 8*f* or by adhesive, screws and the like. It is apparent that a portion of the first side wall 9*a* extends past support 8*g* to provide room for positioning one of the watch case lugs thereagainst as described hereinbelow. The side walls 9*a* and 9*b* are connected together by an end wall 9*c* of selected thickness at which the elongated recess 9*d* in the second side wall terminates as shown. The dimensions of the metal plate 9 typically are 0.750 inch in length, and 0.250 inch in width with the recess being 0.012 inch in depth and 0.125 inch long and 0.110 inch wide. Thickness of the pintle-compressing plate refers to the distance between the first side wall and second side wall and in the embodiment described is selected as 0.012 inch.

The work table 8 is small and compact in size, for example, the base 8*a* is only 4.75 inches long and 2.75 inches wide so that the work table can be conveniently employed in association with a counter-top display such as those used to display wristwatches for sale in retail and drug stores. The work table may, if desired, be permanently affixed to the counter-top display in a customer-accessible location to allow customers to conveniently replace their own watch straps. Or, a non-slip pad 8*m* may be attached to the bottom of the base, FIG. 5 to minimize unwanted movement of the work table. Of course, other shapes and sizes of work tables may be used.

Figure 6:
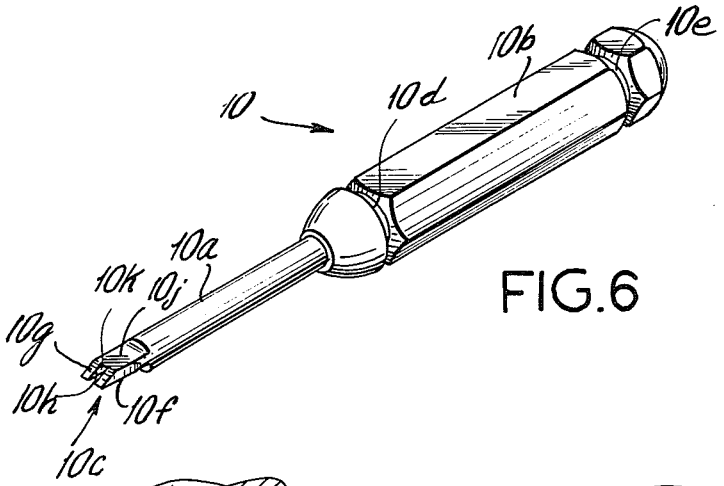
FIG. 6 is a perspective view of a tool with a straight chisel-shaped blade.

FIGS. 6 and 7*a*–7*b* illustrate one tool useful in conjunction with the watch support pad on the work table for strap replacement. The tool 10 comprises a shaft 10*a* having a handle 10*b* at one end and a bifurcated, chisel-shaped blade 10*c* at the other end. The handle has inner circumferential groove 10*d* adapted to be engaged by spring detent 7 in the storage compartment of the work table and outer circumferential groove 10*e* provided to facilitate removal of the tool from the compartment by providing a tactile gripping area on the exposed end of the tool. The blade includes on one side a flat, first surface 10*f* and on the other a tapered or bevelled second surface 10*g* and a third tapered or bevelled surface 10*h*, both of which intersect a flat, third surface 10*j*. Slot 10*k* extends upwardly from the tip of blade to in effect define a pair of claws each with a flat first surface and a tapered second surface. The width of the slot 10*k* is selected to allow the tool to straddle the spring bar connector 4 as shown in FIG. 10*a* with the flat first surface 10*f* adjacent the inner face 2*d* of one of the watch case lugs 2*b* and with the tapered second surface 10*g* adjacent the shoulder 4*e* of the spring-urged pintle engaged to that lug. Removal of the pintle from the watch case lug is effected simply by placing the wristwatch on the work table with the watch crystal 2*k* supported on the watch support pad 8*c* and while holding the watch on the pad, pushing the dismantling tool toward the pad. During movement of the tool past the strap connector, the tapered second surface 10*g* exerts a camming action on the shoulder 4*e* of the pintle in an axial direction away from the adjacent lug to cause the pintle to retract out of the lug hole and thus be released, FIGS. 10*a* and 10*b*. Should the blade of the tool contact the watch support pad, it will not be harmed. The watch strap and connector are then easily pulled from the other lug to effect total disengagement from the watch case.

FIGS. 8*a*–8*d* show the chisel-shaped blades of all four tools 10–13 for direct comparison. It is seen that there are provided two tools 10 and 11 with straight blades 10*a* and 11*a* which differ from another merely in the width of the blade and blade slot to permit different sized spring bar connectors to be gripped. Two tools 12 and 13 are provided with curved blades 12*a* and 13*a* which differ from one another in blade width and blade slot width as well as in the severity of curvature imparted to the blade. FIGS. 9*a* and 9*b* show the curved blade 13*a* of tool 13 enlarged. The selection of blade sizes and shapes is of course determined by considering the different sizes and shapes of watch cases, spring bar connectors and straps to be attached or removed. By providing multiple tools with different blades, the user can select the particular tool most suitable for his or her watch. The tools 10–13 are typically made of hardened and tempered steel suitably machined and bent, although other materials may of course be used.

Attachment of the replacement watch strap is illustrated in FIGS. 11*a* and 11*b*. The first step, FIG. 11*a*, involves inserting the pin 4*c* of the right-hand spring-urged pintle 4*b* into the right-hand lug hole and placing the pin of the left-hand (free) pintle in the recess 9*d* of the second side wall 9*b* of the pintle-compressing member. Then, the left-hand (free) lug is positioned adjacent the first side wall 9*a* in partially overlapping relation such that a portion of the inner lug surface extends longitudinally past the end wall 9*c*, FIG. 11*b*. In effect, this step partially compresses the pintles of the spring bar connector as will be appreciated from FIG. 11*b*. The thickness of the end wall 9*c* is preselected to provide sufficient compression of the pintles to allow the strap connector to fit between the watch case lugs; e.g. a thickness of 0.012 inch has been foundsatisfactory. The watch strap connector is then simply pushed toward the end wall 9*c* to slide the free pintle along the slot 9*d* and past end wall 9*c*, the slot guiding the pintle movement. As soon as the pintle passes the end wall 9*c*, it expands against that portion of the inner lug surface extending past the end wall and into engagement therewith. If the hole of the free lug is properly aligned, the pintle will snap directly into the hole. If there is some misalignment, it may be necessary to lift or depress that end of strap slightly to move the pin of the free pintle into engagement with the lug hole. One side of strap attachment is thus completed since the other pintle has already been engaged in the mating lug hole located in the other inner lug surface. Preferably, the watch lugs 2*b* are supported on the top surface of support block 8*d* during the attachment operation just described. Total strap attachment is completed by repeating the above described steps with the other end of the watch strap.

As depicted in FIG. 12, the tools described hereinabove are also useful in attaching a metal type band or bracelet having a spring bar connector to the watch case lugs 2*b*. Use of the tool in lieu of the pintle-compressing member of the work table may be necessary as a result of the configuration of the metal band and/or the case in the vicinity of the attachment end. Attachment is effected by selecting the tool 10, 11, 12 or 13 which is most suitable for the band and case used, e.g. tool 13 in FIG. 12. Then, one end of the spring bar connector is inserted into the hole in one lug, e.g. the rear lug in FIG. 12. The other end of the spring bar connector is then positioned into the slot 13*k* in the blade 13*a* of the tool (FIG. 13) with the pintle end 4*f* engaging tapered or bevelled surface 13*h* and the end of the spring bar connector is compressed by pushing the tool axially toward the spring bar connector. The watch band is then pivoted toward its mating lug until the compressed end of the spring bar connector is guided into alignment with the hole in the lug. The tool is then removed by retaining the spring bar end of the watch strap with one finger while lifting the tool upwardly away from the pintle, allowing the pintle to snap outwardly into engagement with its mating lug hole. Attachment of the watch band in this manner is best performed on the work table with the watch crystal resting on the work support pad 8*c*.

It is thus seen that the tool kit of the invention satisfies the long felt need for means enabling simplified watch strap replacement, including strap removal and attachment, by unskilled retail clerks and consumers.

A cover member 14 may also be used in conjunction with the components already mentioned as shown in FIG. 3 to provide a compact and neat device. The cover member may be molded plastic bearing an appropriate legend, instructions, trademark, tradename, etc. The cover member is configured to capture the exposed ends of tools 10–13 (FIG. 3) when it is placed over the work table and thereby prevent loss of the tools during transporting. It is also envisioned that the tools 10–13 may be connected to the work table by elongated connector means (not shown) such as a cord, strand, wire or the like to prevent tool loss.

While there have been described herein preferred embodiments of the invention, it is to be understood that various modifications and substitutions can be made in them within the scope of the amended claims which are intended to also include equivalents of such embodiments.

We claim:

1. A work table useful in removing and attaching a watch strap connector between the spaced, facing inner lug surfaces of a watch, wherein the watch strap connector includes first and second spring-urged pintles in opposite ends of a tubular housing, said work table having a working surface with pad means thereon for supporting the watch during removal or attachment of the watch strap connector without marring the watch finish and having a pintle-compressing member supported thereon for facilitating attachment of the watch strap connector, said pintle-corresponding member having a first side wall and a second side wall connected together by an end wall of a thickness selected to compress the pintles of the watch strap connector when the pintle-compressing member is interposed between the inner lug surfaces with the first side wall adjacent one inner lug surface in partial overlapping relation thereto such that a portion of said one inner lug surface extends past the end wall and with second side wall in spaced, facing relation to the other inner lug surface with the watch strap connector therebetween having the first pintle engaged against said other inner lug surface and the second pintle engaged against the second side wall; wherein the second side wall of the pintle-compressing member defines an elongated recess extending toward and terminating at the end wall, said recess being adapted to receive said second pintle and guide it toward the end wall, whereby the second pintle can be brought into engagement with said one inner lug surface simply by sliding said second pintle along the second side wall past the end wall where it will expand against the portion of said one inner lug surface extending past the end wall.

2. A tool kit useful in removing and attaching a watch strap connector between spaced, facing inner lug surfaces of a watch, wherein the watch strap connector includes first and second spring-urged pintles in opposite ends of a tubular housing, said tool kit comprising:

(a) a work table including at least one tool storage compartment and detent means is provided extending into the tool storage compartment to releasably engage the tool stored therein, said work table also having a watch support pad thereon made of a material that will not mar the watch finish when the watch is placed on said pad and having a pintle-compressing member with a first side wall and second side wall connected together at one end by an end wall of a thickness selected to compress the pintles of the watch strap connector when the pintle-compressing member is interposed between the inner lug surfaces with the first pintle engaged against one inner lug surface and with the second pintle engaged against the second side wall of said pintle-compressing member, whereby said second pintle can be brought into engagement with the other inner lug surface simply by sliding said second pintle along the second side wall past the end wall where it will expand against the other inner lug surface which is prepositioned adjacent the first side wall and extending past the end wall, and further comprising (b) at least one tool for removing the watch strap connector from the inner lug surfaces while the watch is supported on the watch support pad of the work table, said tool comprising a shaft with handle means at one end and a bifurcated, chisel-shaped blade at the other end.

3. The tool kit of claim 3 wherein the tool includes a groove in the handle means which is engaged by the detent means extending into the storage compartment.

4. The tool kit of claim 2 having a cover member adapted to fit over the work table, said cover member being shaped to capture the tool when it is stored in the storage compartment of said work table.

5. The tool kit of claim 2 wherein the first side wall of the pintle compressing member includes an elongated recess extending toward and terminating at the end wall, said recess being adapted to receive said second pintle and guide it toward the end wall.

6. A tool kit useful in removing and attaching a watch strap connector between spaced, facing inner lug surfaces of a watch, wherein the watch strap connector includes first and second spring-urged pintles in opposite ends of a tubular housing, said tool kit comprising:

(a) a work table having an upper working surface, lower base and connecting walls therebetween, at least one of said connecting walls including multiple openings extending into the work table to provide multiple tool storage compartments, said working surface having a watch support pad thereon made of a material that will not mar the watch finish when the watch is placed on said pad and having a pintle-compressing member with a first side wall and second side wall joined together at one end by an end wall of a thickness selected to compress the pintles of the watch strap connector when the pintle-compressing member is interposed between the inner lug surfaces with the first pintle engaged against one inner lug surface and with the second pintle engaged against the second side wall of said pintle-compressing member, whereby said second pintle can be brought into engagement with the other inner lug surface simply by sliding said second pintle along the second side wall past the end wall where it will expand against the other inner lug surface which is prepositioned adjacent the first side wall and extending past the end wall, (b) detent means associated with said work table and extending into the multiple tool storage compartments, and (c) multiple tools for removing the watch strap connector from the inner lug surfaces and adapted for storage when not in use in the tool storage compartments, said tools each comprising a shaft with handle means at one end and a bifurcated, chisel-shaped blade at the other end, said handle means of each tool including means adapted to be releasably engaged by said detent means to hold the tool in a respective one of the tool storage compartments.

7. The tool kit claim 6 wherein the detent means comprises a spring detent and the handle means of each tool includes a circumferential groove to be engaged releasably by the spring detent.

8. The tool kit of claim 6 further including a cover member adapted to fit over the kit and adapted to capture portions of the tool handle means extending out of the storage compartments.

* * * * *